US006492784B1

(12) United States Patent
Serrano

(10) Patent No.: US 6,492,784 B1
(45) Date of Patent: Dec. 10, 2002

(54) PROPULSION DEVICE AND METHOD EMPLOYING ELECTRIC FIELDS FOR PRODUCING THRUST

(75) Inventor: Hector L. Serrano, Kissimmee, FL (US)

(73) Assignee: Gravitec, Inc., Kissimmee, FL (US)

( * ) Notice: Subject to any disclaimer, the term of this patent is extended or adjusted under 35 U.S.C. 154(b) by 0 days.

(21) Appl. No.: 09/518,605

(22) Filed: Mar. 3, 2000

Related U.S. Application Data

(60) Provisional application No. 60/123,086, filed on Mar. 5, 1999.

(51) Int. Cl.[7] ..... G21K 1/00; H01J 5/06

(52) U.S. Cl. ..... 315/506; 315/111.61; 60/202; 60/200.1

(58) Field of Search ..... 315/506, 111.61; 60/202, 200.1

(56) References Cited

U.S. PATENT DOCUMENTS

| | | | |
|---|---|---|---|
| 1,003,484 | A | 9/1911 | McFeely |
| 1,363,037 | A | 12/1920 | Goddard |
| 1,974,483 | A | 9/1934 | Brown |
| 2,004,352 | A | 6/1935 | Simon |
| 2,210,918 | A | 8/1940 | Karlovitz et al. |
| 2,231,877 | A | 2/1941 | Bennett |
| 2,279,586 | A | 4/1942 | Bennett |
| 2,305,500 | A | 12/1942 | Slayter |
| 2,588,427 | A | 3/1952 | Stringfield |
| 2,949,550 | A | 8/1960 | Brown |
| 3,018,394 | A | 1/1962 | Brown |
| 3,022,430 | A | 2/1962 | Brown |
| 3,187,206 | A | 6/1965 | Brown |
| 3,374,941 | A | 3/1968 | Okress |

(List continued on next page.)

OTHER PUBLICATIONS

David, Leonard, *Warning, Mind Fields, Nasa Looks Into Breakthrough Physics*, Final Frontier, Jan./Feb. 1997, pp. 19–23.

*Gravity Wave Sensor Circuits*, Internet Address *http://www.t–link.net/~aquarius/gwrphome*, Aug., 1997, pp. 1–6.

*Data Examples and Measurement Techniques*, Internet Address *http://www.t–link.net/~aquarius/gwrphome*, Aug., 1997, pp. 1–5.

*Primary Examiner*—Bruce Anderson
*Assistant Examiner*—Nikita Wells
(74) *Attorney, Agent, or Firm*—Allen, Dyer, Doppelt, Milbrath & Gilchrist, P.A

(57) ABSTRACT

Thrust is provided to a vehicle using a self-contained device for producing the thrust through a preselected shaping of an electric field. The device includes a core carried by a housing, with both the core and the housing formed from a material having a high dielectric constant. Multiple cells are carried by the housing and formed around the core, with each cell having a high dielectric sandwiched between an electrode and a lower dielectric. A channel is formed between each cell with the channel providing a spacing filled with a material having a dielectric property of the lower dielectric. Electric wires are connected between an electrical power source and each electrode of each cell for providing power thereto. A set of cells extends radially outward from a longitudinal axis of a cylindrical core to form a circular plate with each cell uniformly positioned within the circular plate. Multiple plates are stacked along a longitudinal axis of the core with the electric wire carried through the high dielectric for connection with the electrodes of each plate. Positive and negative voltage is provided to adjacent plates at a rapidly changing rate to provide thrust resulting from non-linear electric field paths created through the device as a result of the cell and surrounding dielectric material configuration.

33 Claims, 7 Drawing Sheets

U.S. PATENT DOCUMENTS

| | | | | |
|---|---|---|---|---|
| 3,411,025 | A | | 11/1968 | Marks |
| 3,518,462 | A | | 6/1970 | Brown |
| 3,662,554 | A | | 5/1972 | De Broqueville |
| 3,892,927 | A | | 7/1975 | Lindenberg |
| 4,126,434 | A | | 11/1978 | Keiichi |
| 4,232,355 | A | | 11/1980 | Finger et al. |
| 4,259,707 | A | | 3/1981 | Penney |
| 4,369,776 | A | | 1/1983 | Roberts |
| 4,663,932 | A | * | 5/1987 | Cox ..... 60/200.1 |
| 4,789,801 | A | | 12/1988 | Lee |
| 4,891,600 | A | | 1/1990 | Cox |
| 5,207,760 | A | | 5/1993 | Dailey et al. |

* cited by examiner

PROPULSION DEVICE AND METHOD EMPLOYING ELECTRIC FIELDS FOR PRODUCING THRUST

CROSS REFERENCE TO RELATED APPLICATION

This application incorporates by reference and claims priority to Provisional Application Serial No. 60/123,086 for "FIELD PROPULSION APPARATUS AND METHOD" having a filing date of Mar. 5, 1999, and commonly owned with the instant invention.

FIELD OF THE INVENTION

The present invention relates to conversion of energy, and in particular to the use of electrical potentials for producing forces to cause motion of a structure by direct operation of electric fields, thus providing a thrust sufficient for propelling a vehicle.

BACKGROUND

Field propulsion is an electrical phenomenon, which employs an electric field and electric field effects for generating propulsion forces. As disclosed in U.S. Pat. Nos. 2,949,550 and 3,187,206 to T. T. Brown, through an electrokinetic phenomenon, electrical energy can be converted to mechanical energy which is then used to provide a force for providing movement to a structure. However, except for insignificantly small forces of electrostatic attraction and repulsion, electrical energy has not been used for the direct production of force and motion. As of this writing, decades later, a practical use of available electrokinetic effects has not been provided.

As is well known in the art, and as emphasized by Brown, the elimination of machinery for intermediate conversion of energy provides a great cost savings, and greatly reduced weight and space. Such is desirable in self-propelled vehicles including aircraft and especially space craft. Since any conversion of energy from one form to another is accompanied by losses due to friction, radiation or conduction of heat, hysteresis, and the like, as well as serious reductions in availability of the energy by increases in entropy of the system, it is apparent that great increases in efficiency may be achieved through the use of the direct production of forces to produce motion from electrical energy, the subject of the present invention.

By way of further example regarding use of field in moving bodies, U.S. Pat. No. 3,662,554 to DeBroqueville discloses an electromagnetic propulsion device including annular electrodes disposed on an outside dielectric surface of a body for providing a propulsion electromagnetic force field around the body to decrease overpressure in front of the moving body within a surrounding fluid for reducing a shock wave resulting from the overpressure. U.S. Pat. No. 5,207,760 to Dailey et al. discloses an electric engine useful in sustaining space travel. The electric engine includes a pulses inductive magnetic thruster powered by a nuclear reactor. A gas is discharged against an inductor comprising a series of parallel coils arranged in a spiral fashion with capacitors connected thereto for charging and discharging simultaneously by a trigger generator immediately after a puff of propellant gas reaches the inductor. Current and magnetic field in the ionized gas drives the gas away from the coils creating a thrust which drives the spaceship.

As further disclosed in U.S. Pat. No. 4,891,600 to Cox, by way of example, when a spacecraft is in space or in an orbit, it is desirable to have a ratio of thrust produces to a rate of consumption of fuel to be as high as possible, thus producing a high specific impulse. One such propulsion system is an electrostatic propulsion system, wherein the thrust is created by electrostatic acceleration of ions created by an electron source in an electric field. However, where a large amount of thrust is needed, the weight of such an electrostatic system is excessively high. A dipolar force field propulsion system is disclosed by Cox which includes electric and magnetic field formed to create a spacial force field into which a particle is transported causing the dipole of the particle to be driven into a cyclic motion at a frequency which accelerates the particle. The acceleration of the particle in a space craft having the induced dipole electromagnetic propulsion system is accelerated by a reactive thrust. However, in spite of such developments since the disclosures of Brown, there still remains a need for providing a propulsive force within a relatively simple and inexpensive engine capable of being driven by well accepted power sources, while maintaining a high specific impulse that results from a generally light weight structure.

SUMMARY OF INVENTION

In view of the foregoing background, it is therefor an object of the present invention to provide a device for a practical conversion of energy of an electrical potential to a mechanical force suitable for propelling a transport vehicle.

This and other objects, features, and advantages of the invention are provided by a device for producing thrust through a preselected shaping of an electric field. The device comprises a housing and a core carried by the housing, wherein the core and the housing are formed from a material having a high dielectric constant. A cell having a high dielectric is sandwiched between an electrode and a lower dielectric, with a plurality of cells carried by the housing and formed around the core. A channel is formed between each cell for spacing thereof, wherein the channel is filled with a material having a dielectric property of the lower dielectric. Electrical connection means is provided for connection between an electrical power source and each electrode of each cell for providing power thereto.

In one preferred embodiment, the core comprises a cylindrical shape having a longitudinal axis extending along a direction of thrust. The core can be extended beyond a top surface and a bottom surface of a cell assembly for providing a structural attachment to a vehicle with which the device is operable. One set of cells extends radially from a longitudinal axis of the core to form a circular plate with each cell within the plate uniformly positioned therein. The electrical connection means comprise a wire carried through the high dielectric for connection with the electrode at a generally central location thereof. A plurality of wires extends radially from one cell to an adjacent cell within the plate for the connection to the electrical power source. A bridge conduit extends between adjacent cells within one plate having the adjacent cells therein. The bridge conduit provides a wire path for connection of the electrodes carried within the one plate, the bridge conduit further formed from a dielectric material having the dielectric properties of the high dielectric for the cell. An electric power supply provides voltage and current to the electrodes, with positive and negative signal connections to adjacent plates.

In a method aspect of the invention, the electrodes are provided with a rapidly changing charging voltage and/or changing current for enhancing the thrust provided from the self-contained device.

An electric field can either be of and alternating current (AC) or direct current (DC) type. As will herein be described, one preferred embodiment of the present invention includes the use of AC fields. A field propulsion device can operate using either an AC or DC electric field to cause a non-linear field geometry to form between at least two electrode plates. This non-linearity is accomplished even in a fully geometrically symmetrical capacitor through a polarity difference between plates. The polarity difference between positive and negative potentials has a flux density that is higher at the positive pole then at the negative pole thus creating a relative non-linearity for even the geometrically symmetrical capacitor. All capacitors share this phenomenon as described, by way of example, in U.S. Pat. Nos. 3,187,206; 3,018,394; 3,518,462; 3,022,430; 2,949,550; and 1,974,483 to Brown. However, none have been optimized to take advantage of this effect, as herein described for the present invention. This non-linearity will cause a thrust effect to be generated in the direction of largest flux density, in other words, in the direction of largest field curvature, no mater the charge polarity of capacitor plates relative to each other.

BRIEF DESCRIPTION OF DRAWINGS

A preferred embodiment of the invention, as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
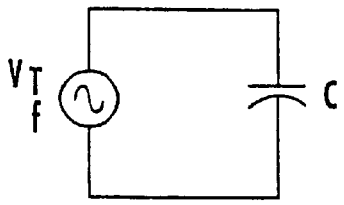
FIG. 1 is a schematic diagram illustrating a capacitive circuit.

By way of further background, and with reference initially to FIG. 1, in a capacitive circuit, the amount of power absorbed by a field developed within a dielectric is equal to the amount of the power returned to the circuit when the field collapses. Further, a capacitor will absorb power for one half of an applied AC cycle and return the power to the circuit during the next half of the cycle. By way of example, a DC charged capacitor is limited, because even by placing components in a fashion that orientates an electric field for generating thrust in one direction, no mater the relative polarity, a DC charged capacitive device can not operate as well as an AC powered capacitor because it can not make use of charging rates of change in voltage as easily as can an AC powered device.

However, a pulsing DC is for all intents and purposes a regular direct current that will charge the capacitor and unless the capacitor dissipates that energy before the next pulse occurs, the capacitor will still have a residual charge that will remain until the next pulse. It has been discovered that a preferred effect occurs when the capacitor is initially charging, not when it is constantly charged as in a typical DC system. The charging time is associated with a drift velocity of charges. The DC device of the present invention operates with a constant charge rate that will, as the capacitor is increased in power, reach a saturation level of the capacitor and begin to create a leakage current. The leakage current will continue to build up until the device suffers a dielectric breakdown where arcing occurs, thus limiting the maximum energy that can be induced unto a DC device, significantly more than in a typical AC powered device.

Figure 2:
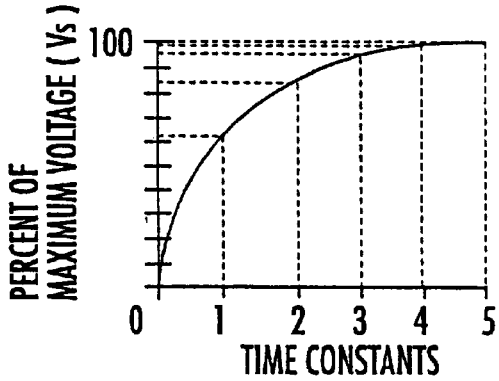
FIGS. 2 and 3 are plots of voltage versus time illustrating charging and discharging time, respectively, for a capacitor in a DC circuit of FIG. 1.
Figure 3:
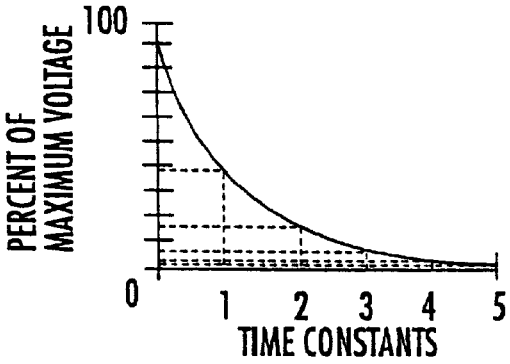
Figure 4:
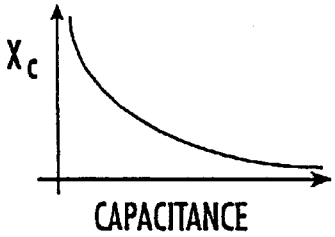
FIGS. 4 and 5 are plots illustrating relationships of reactance $X_c$ caused by capacitance and frequency in an AC powered capacitor, respectively.
Figure 5:
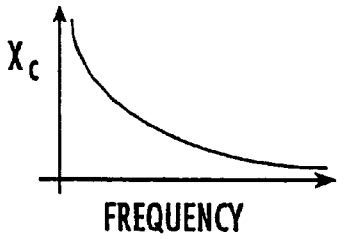

While an AC powered device can experience similar effects as does a DC powered device, its reversal of polarity and rate of cycles can take advantage of the superior thrust generated at the first few micro seconds of the charging time. This has the effect of generating more thrust with the same amount of energy input. As a result, higher power input levels can be reached without exceeding the rated power of the capacitor. The cycles reverse themselves before the maximum power rating is reached and a relative reversed polarity state compared to the previous cycle is induced. Since an AC cycle first charges the capacitor and then discharges it, followed by a relative polarity reversal, the capacitor can take full advantage of the best charging cycle frequency to power ratio and can thus generate a superior thrust effect. Charging and discharging time in a DC circuit is illustrated, by way of example, with reference to FIGS. 2 and 3. As illustrated, the charging of the capacitor is rapid at first, but slows down considerably as it reaches a full charge. The same holds true for the discharge rate. Reactance causes the slowing down in both cases, with the charges repelling each other during the charging and discharging process. Reactance is the resistance that charged particles experience as the capacitor charges. FIGS. 4 and 5 illustrate relationships of reactance $X_c$ caused by capacitance and frequency in an AC powered capacitor, respectively. As frequency increases capacitance decreases. As frequency decreases, reactance increases without changing the structure of the capacitor. If we were to increase capacitance by changing the structure of the capacitor, and if we increase capacitance, the reactance decreases. If we decrease capacitance, reactance increases.

Figure 6:
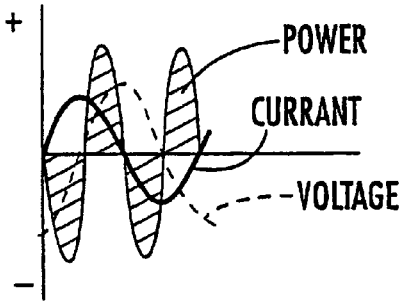
FIG. 6 is a plot illustrating a relationship between power, voltage and current within an AC circuit.

As a result of the arrangement of capacitor plates, a polarity reversal has the same effect on both the positive and negative cycle and thus generates thrust at both sides of the cycle. With reference to FIG. 6, power being absorbed and returned to the circuit is illustrated within shaded areas under a positive and negative voltage cycle. The shaded areas above and below the baseline represent power that is absorbed by the capacitor. The solid curve line represents a current level rising and dropping as the AC cycles reach their peak to peak values. The dashed curve line represents voltage. Values for both the current and the voltage curve lines are dependent on a structure of the capacitor and a form of the power input. The amount of current that goes through a capacitor depends on the potential difference and the properties of that capacitor. However, in a capacitor, at any preselected AC potential difference, the current is greater at higher frequencies.

As a result, an AC system, especially a capacitive as will herein be described in further detail, can use the charging time to its advantage as well as the polarity reversal cycle. Be reminded that the reversal of polarity in a cycle is always a positive energy input. Thus, positive and negative polarity will have the same effect, and can both take advantage of the above charging time effect.

Also in a DC capacitor, the use of materials having a relatively low dielectric constant, the degree to which a material can resist flow of an electric charge, is effective in creating thrust because it is such a material through which currents will flow. In a DC system, this has the effect of charging the capacitor, while on the other hand, an AC current can travel through a material that normally DC could not, given the same amount of capacitance to hold the voltage, because of the charging time frequency advantage. Further, while a DC powered capacitor must use low rated dielectrics which limit the total capacitance, the AC powered devices can use high rated dielectrics and thus allow for extremely high rated capacitors to be made that can thus have even higher power ratings. This added to the charging time advantages results in a higher thrust without a significant increase in size of such capacitors, and thus devices. Since the AC device uses the energy more efficiently by generating thrust in the first moments of the charging cycle, then the same power (e.g. watts) yields more force.

Figure 7:
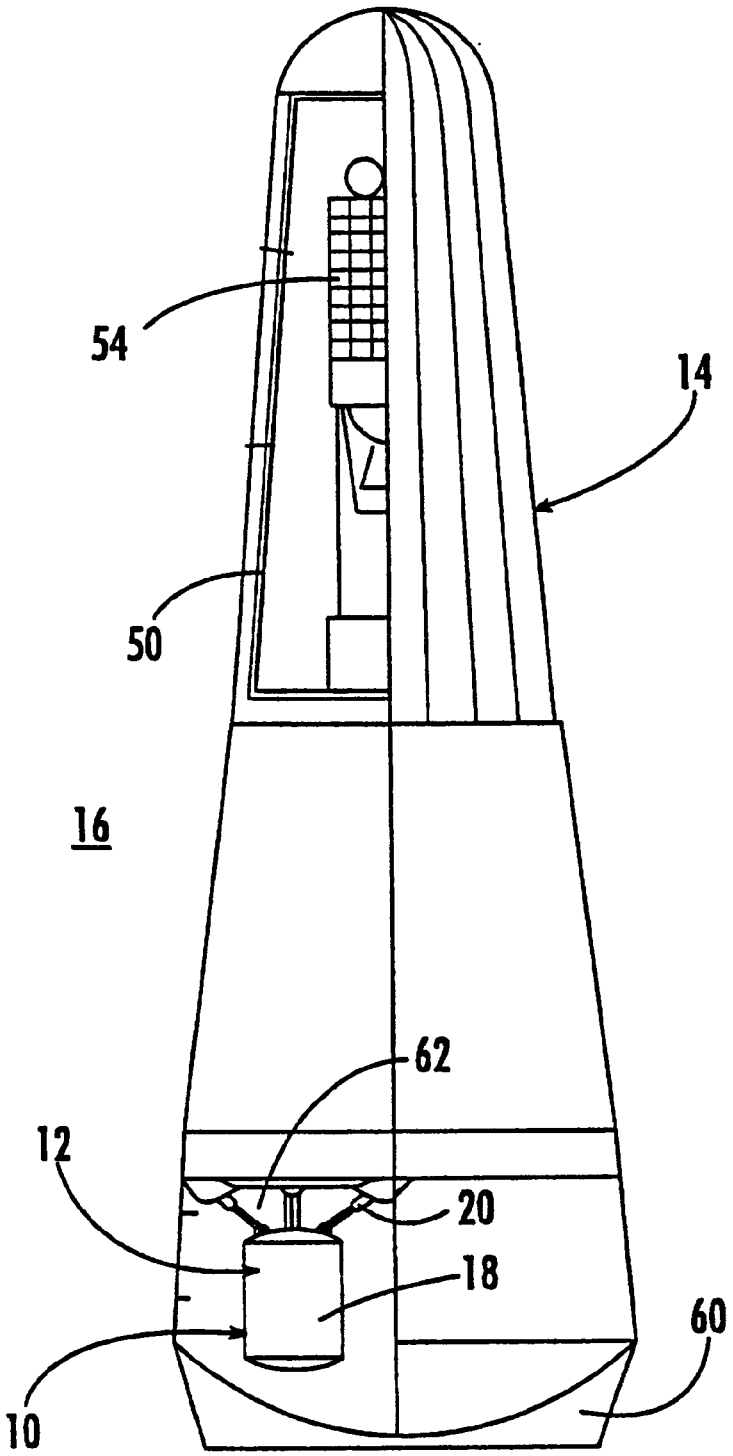
FIG. 7 is a partial cross-section view of a vehicle illustrating one embodiment of a device of the present invention.

As illustrated with reference to FIG. 7, a device 10 of the present invention provides an engine 12, by way of example, for a vehicle 14 when employing the above described techniques, with such an engine being self-contained and carrying its own environment. Thus, the engine 14 can operate within the vehicle 14 without the need for direct exposure to the surrounding environment 16 through which the vehicle is moving. As a result, since the device 10 employing field propulsion can propel itself without exhausting any matter in the opposite direction of vehicle motion, it can propel itself without being exposed to the environment 16 through which it is moving.

Such self-containment serves multiple purposes. First it makes the device 10 of the present invention safer by allowing the device to have a casing or housing 18 for operation of the device with minimum danger to users. Second the housing 18 is useful because it can be made into an RF or electromagnetic shield. Third, since the device 10 is electrical in nature, the housing 18 provides protection for the device against foreign objects or grounding contacts that could cause short circuits. The housing 18 also provides a convenient means from which to transfer propulsive forces created by the device 10 to the vehicle 14 such as a spacecraft, as herein described by way of example, automotive vehicles, marine vehicles, and aircraft.

Figure 8:
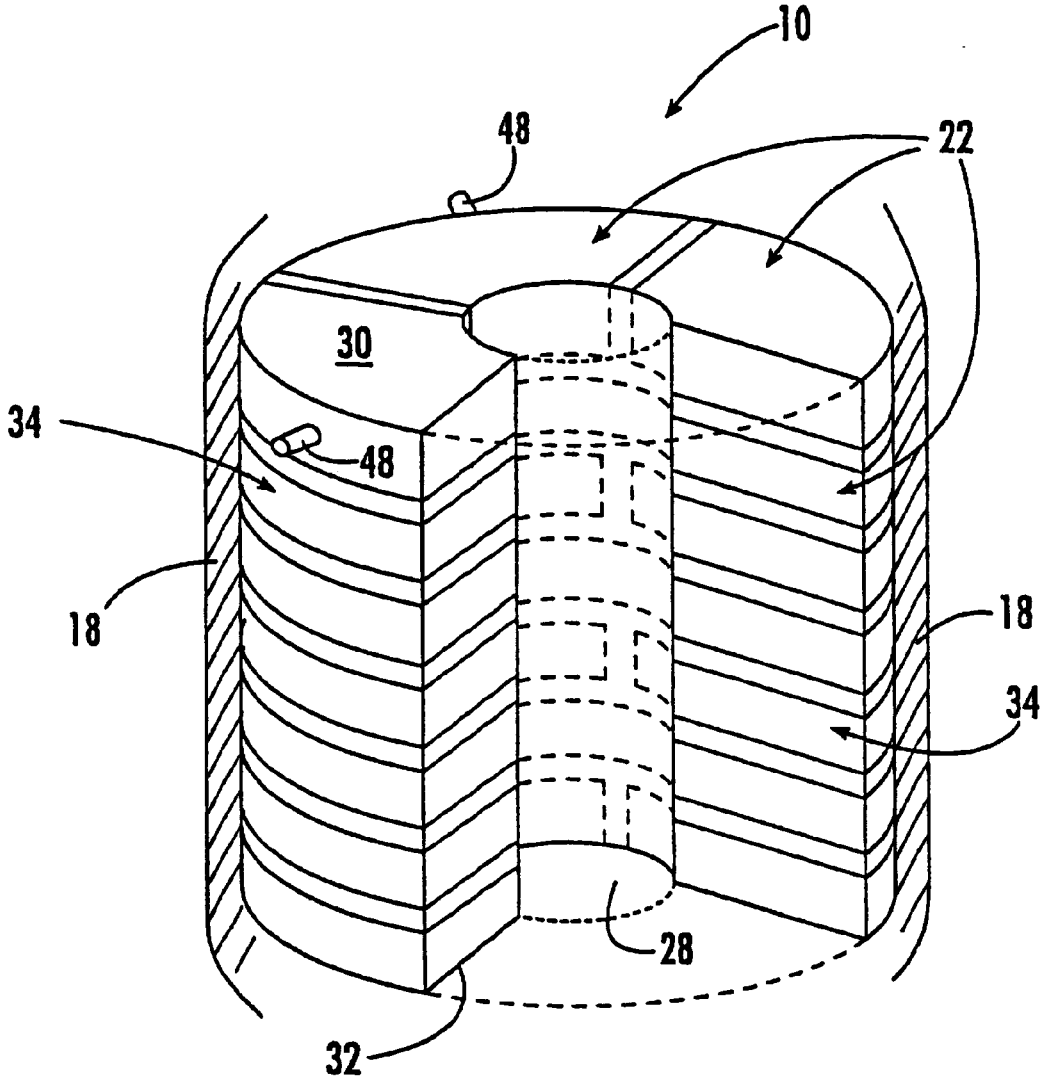
FIG. 8 is a partial perspective and cross-section view of one field propulsion device of the present invention.

With reference to FIG. 8, one embodiment of the device 10 includes a plurality of engine cells 22 arranged about an axis 24 of the device. In the embodiment herein described, by way of example, the plurality of cells 22 are juxtaposed radially outward from the axis 24 and longitudinally along the axis. As illustrated with reference to FIG. 9, a preselected number of cells 22 will be arranged to meet the need for providing desired forces to be delivered, the more cells, the more power, the more thrust. As illustrated with reference to FIG. 10, the radial arrangement of cells 22 form a plate 26. Thus, with the formation of the plate 26, as desired, stacking of the plates will provide the desired size. Further, and as illustrated with reference to FIG. 11, neighboring plates will be supplied with opposing positive and negative charge, with the thrust directed toward the positive charge.

Figure 9:
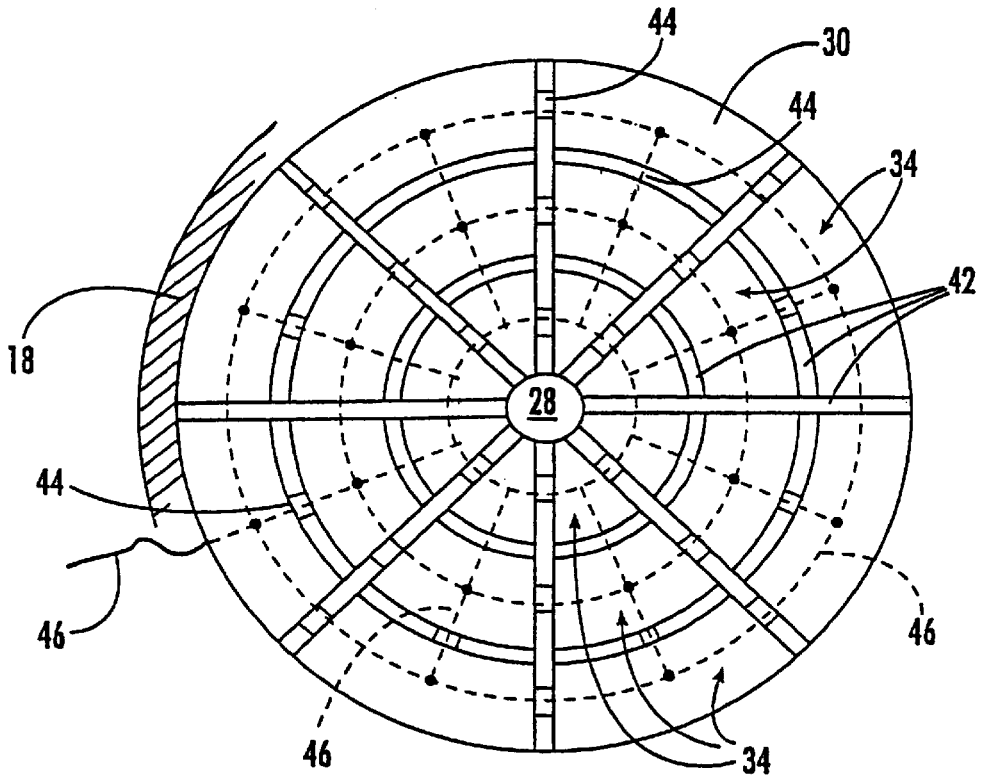
FIG. 9 is a partial top plan view of one embodiment of the present invention illustrating one preselected arrangement of cells.
Figure 10:
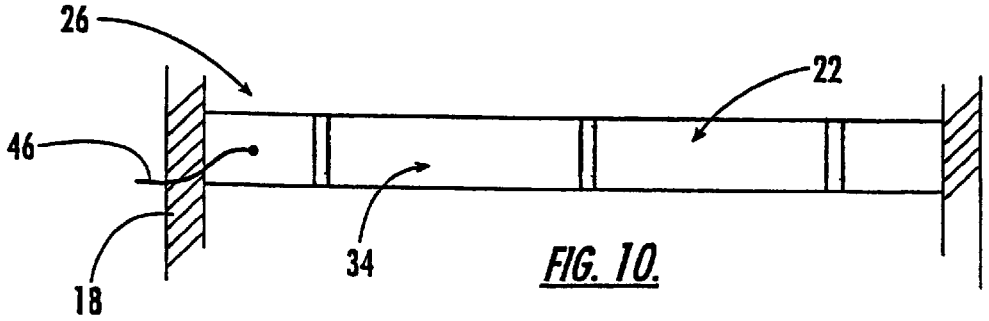
FIG. 10 is a side elevation view of cells forming a plate of FIG. 9.

As further illustrated with reference to FIG. 11, and again to FIGS. 8 and 9, the cells 22 are assembled circumferentially around and longitudinally along a core 28, which core extend to and, if desirable, beyond top and bottom surfaces 30, 32 of a cell assembly 34 formed therefrom. With the core 28, formed from a high dielectric material, a connection to a structure of the vehicle 14 can be made. The core material should preferably be made from a relatively strong material with a high dielectric constant, for facilitating construction of the device 10 and transferring of forces generated by the engine cells 22.

As an alternative, and as earlier described with reference to FIG. 7, the device 10 is attached via the housing 18. Each cell 22, in a preferred embodiment herein described by way of example, includes a high dielectric 36 sandwiched between a conductive material forming an electrode 38 and a lower dielectric 40. Generally, the electrodes 38 will be formed from a copper sheet material, aluminum sheet material, and the like. The high dielectric 36 is preferably has similar dielectric properties as the core 28, for generally preventing current flow therethrough. While the lower dielectric 40 includes dielectric properties that permit current flow, and thus a field path therethrough. Preferably, the cell 22 is positioned with the electrode 38 placed to form a top of each cell, with the high dielectric 36 having a larger thickness than the lower dielectric 40, to further discourage an electric field path through the high dielectric, as herein illustrated.

Figure 12:
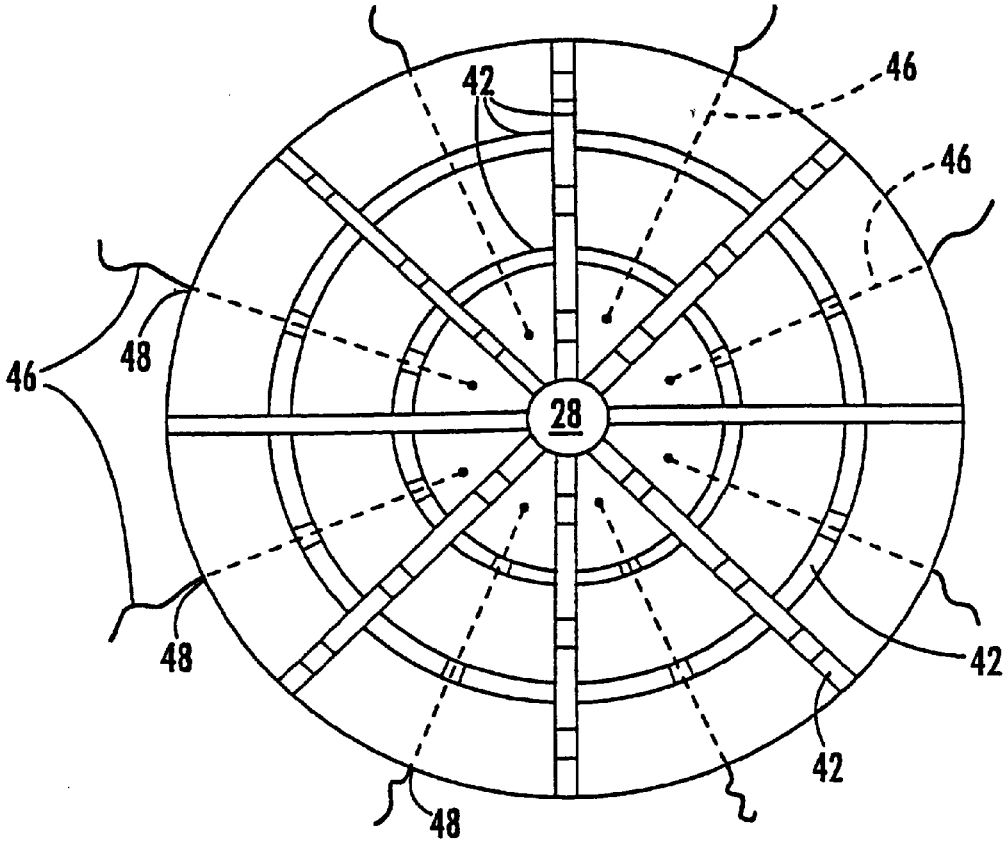
FIG. 12 is a partial top plan view of the embodiment of FIG. 9 illustrating an alternate arrangement of electrical wire routing to cells.
Figure 13:
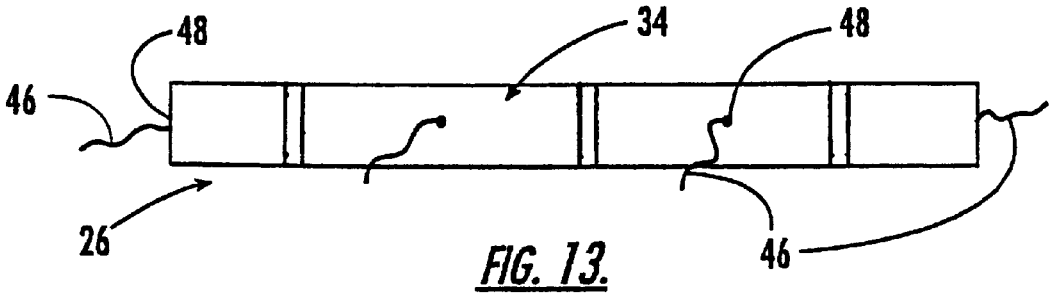
FIG. 13 is a side elevation view of the cells forming the plate of FIG. 12.

With reference again to FIGS. 9 and 11, each neighboring cell 22 is separated by a lower dielectric forming a channel 42. The channel 42 fills a gap between the cells 22 and functions as a circumferential spacer therebetween. Preferably, the material forming the channel 42 has similar dielectric properties and the lower dielectric 40 forming a part of the cell 22. In this way, the channel 42 and the lower dielectric 40 provide an electric field path shaping that is further formed around the high dielectric material 36, thus providing the desirable non-linear path for producing thrust. It is also preferred that the material used to form the housing 18 has similar dielectric properties as does the high dielectric 36. A bridge power conduit 44 is further provided at a plurality of locations within the channel 42 for carrying electrically conductive wire 46 from cell to cell, as illustrated with reference again to FIGS. 9 and 10. Material filling the conduit preferably includes similar dielectric properties as the high dielectric 36. The electrical wire 46 is connected to the electrodes 38 of cells 22 within one plate 26, as illustrated with reference again to FIG. 9, and alternatively by way of example, with reference to FIGS. 12 and 13. Preferably, the connection of the wire 46 is made at a generally central location of the electrode 38, with such connection of the wire 46 to each cell 22 within a plate 26 distributing energy evenly between all the electrodes in that plate. The electrical wire 46 is carried through a power input conduit 48 within each cell 22.

Figure 14:
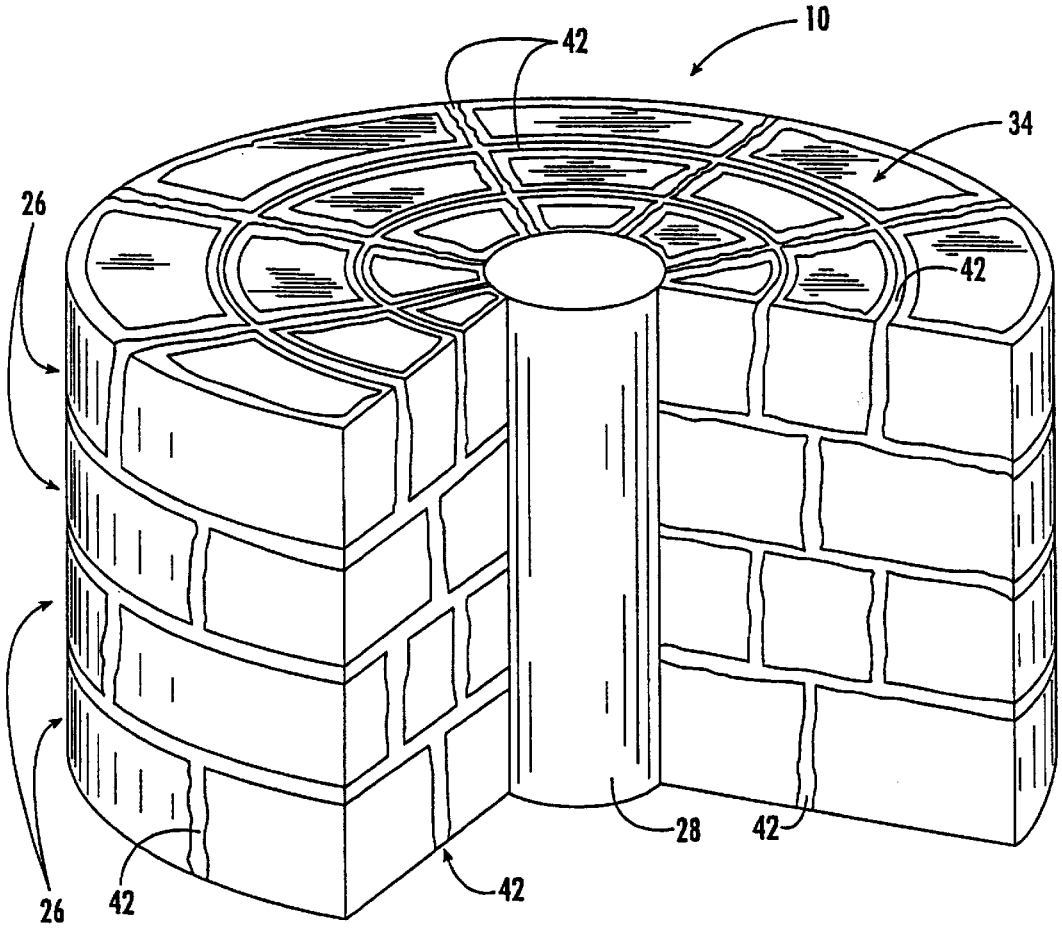
FIG. 14 is a partial perspective cut-away view of one embodiment illustrating a staggered adjacent plate orientation.

In an alternate embodiment, and as illustrated with reference to FIG. 14, a staggered arrangement of plates 26 is provided, which arrangement serves to further increase non-linearity of the electric field, and therefore thrust.

As a result, the device 10 of the present invention, generates a useful motive force using non-linear AC or DC electric fields applied between at least two electrodes divided by a dielectric. As earlier described, it is intended that the device 10 be preferably used with AC generated electric fields to take advantage of the charging time phenomenon to extract the maximum amount of force from the input energy field. Further, the materials that make up elements of the device 10 also serve the purpose of transferring a mechanical force of the device to a support 20 or directly to the vehicle 14, as illustrated again with reference to FIG. 7.

With the formation of non-linear fields created by the above described structure for the device 10, the device can be used on the outside of a vehicle to create a propulsive force on the entire mass of the vehicle. The combined use of the internal engines 12 in combination with outer propulsion effect will produce a more efficient control of the vehicle 14. Further, the use of a vehicle skin 50 or outer hull for carrying the electrodes on a dielectric allows the entire vehicle to be used to create thrust. As herein described, by way of example, the use of the internal engine 14 allows the device 10 to induce lines of force to collapse towards an area where the engine is positioned, thus increasing the non-linearity of the field.

By way of further detail regarding the preferred embodiment herein described by way of example, and with reference again to FIG. 11, the channels 42 and the lower dielectric 40 of the cell 22, as well as the high dielectric 36 improve performance of a set of neighboring plates 26 by increasing the amount of energy being used in a device and allowing that energy to generate a respective thrust without any increase in size. The channels 42 also increase the field effect by allowing the lines of force to be in a generally parallel arrangement, which, as is appreciated by one of skill in the art, increases the Lorentz force effect and therefore the field propulsion effect. The Lorentz force has been observed through experimentation as an important factor in the thrust generating phenomenon. The more parallel the lines of force are relative to each other, the larger the force effect for a given energy input. The Lorentz force is a recognized phenomenon that works partially by the forces generated between drift velocities of charges.

The geometrical shape of the cell assembly 34, by way of example, cylindrical, circular, square, and the like, is not as important as what is done with the shape to optimize the drift velocity of the charges or energy input. The segmentation of the cells 22 for the device 10 as herein described, allows for control of the field by the variation of the potential of the cells and plates themselves and its intensity between the cells and plates, which is accomplished by an electronic control.

Further, the routing of the wire 46 providing power lines to the respective plate 26 through the high dielectric material 36 serves the useful purpose of keeping arcing events to a minimum by distributing the energy over the plates and not at any one single wire point location. This prevents arcing at the leads and so maintains the needed power balance. Furthermore, the multi-port input to a plate 26, as described earlier with reference to FIG. 12, and shared connection of input, as illustrated with reference again to FIGS. 9 and 12, by way of example, are used to more equally distribute the energy.

Figure 11:
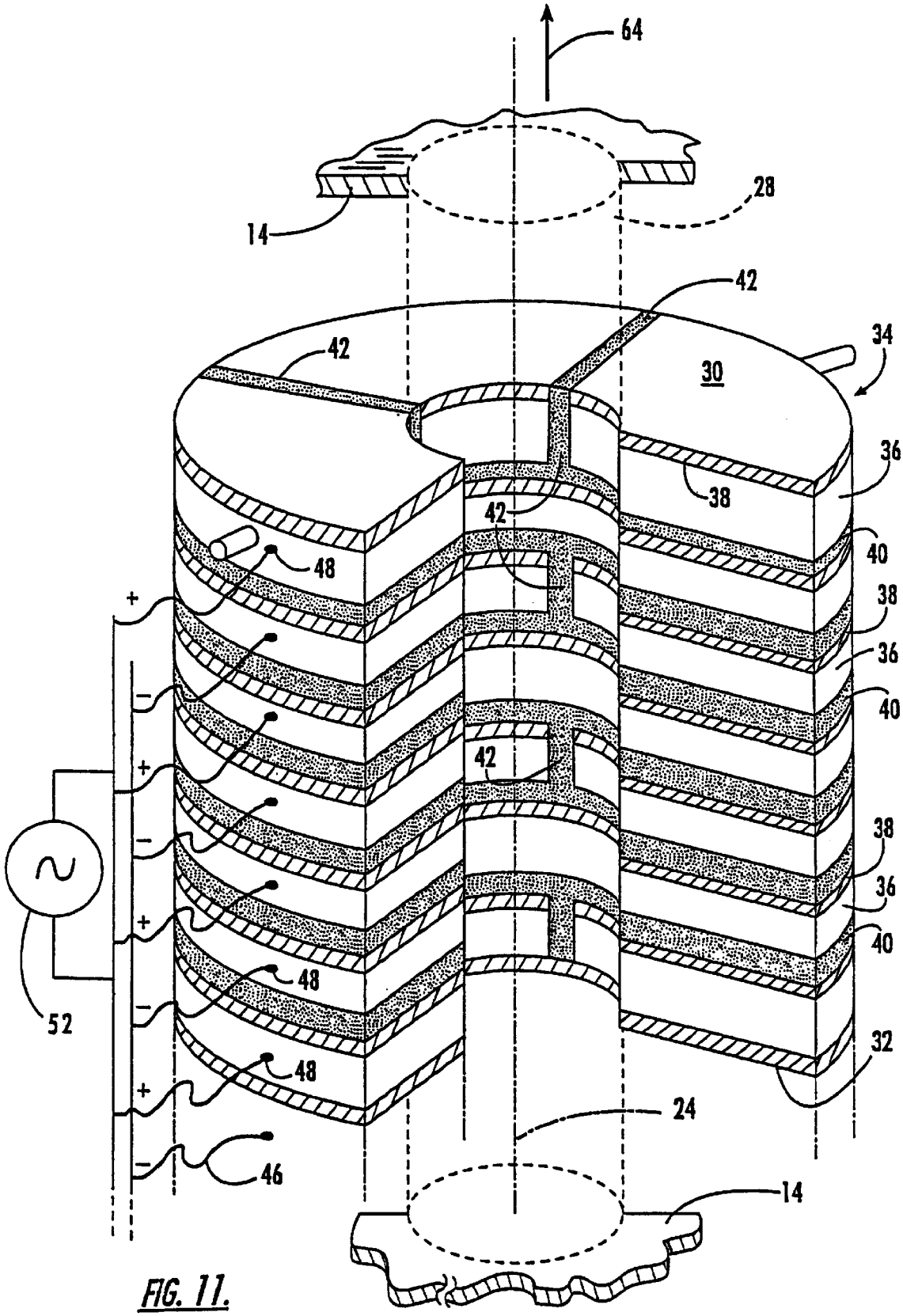
FIG. 11 is a partial perspective and cross-section view illustrating an embodiment of the present invention.

As earlier described with reference to FIG. 11, the dielectric material in the channel 42 is preferably of a relatively lower dielectric constant than the dielectric 36 on which the electrode 38 is placed to allow for a non-linear relationship to form between plates 26 and their respective electrodes. Further, there is a layer of dielectric material between the cells 22 created by the lower dielectric 40 of lower dielectric strength as for material in the channels 42. This allows the desirable formation of the non-linearity in the field. The plates 26 can be arranged so that the channels 42 are aligned with the next set of plates as earlier described with reference to FIG. 11, or staggered to cause a larger non-linearity effect, as earlier described with reference to FIG. 14.

By the use of an electrical power source 52, constant DC and preferably pulsing DC, will provide a useful force generated by the field propulsion device 10 of the present invention, herein described. Further, as earlier described with reference to FIG. 6, taking advantage of the initial power increase within an AC supply of power provides yet further thrust from the device 10.

With reference again to FIG. 7, for an alternate embodiment of the device 10, as herein described, it is expected that the teachings of the present invention will encourage use of a nose section 54 of the vehicle 14 to be segmented into sections as herein described for the device 10. An vehicle inner wall 56 will be made into a RF or electromagnetic shield without disturbing the thrust generating effect. The overall structure of the vehicle 14, like the cell 22, is made of a dielectric material on which electrode are positioned and through which the power is routed. The vehicle 14 will contain a main machinery bay 58 for housing key components. The outside walls of the bay are made from a dielectric material. The bottom wall 60 of the vehicle will be formed as yet another electrode, with the result that vehicle structure includes electrodes and dielectrics to generate thrust by the use of the field propulsion phenomenon, herein described for the present invention. Such a vehicle can then operate in any dielectric environment such as air or the vacuum of space. The internal engine 12 earlier described can then be used in conjunction with or as separate propulsion systems.

The internal engine 14, unlike the engine formed form the structure of the vehicle can generate thrust in any environment because it is shielded from the environment through which the vehicle 12 is traveling. As illustrated with reference again to FIG. 7, an hydraulic system 62 is one example of a means of vectoring the engine 12 side to side to maneuver the vehicle 12. For the device 10 herein described with reference to FIG. 11, by way of example, generated a thrust in a direction as indicated by arrow 64. In contrast, the vehicle skin propulsion can provide a thrust vector by charging a section of its skin at higher potential relative to the other sections and thus generate more thrust from that section than from others.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

That which is claimed is:

1. A device for producing thrust through a preselected shaping of an electric field, the device comprising:

a housing;

a core carried by the housing, wherein the core and the housing are formed from a material having a high dielectric constant;

a cell having a high dielectric sandwiched between an electrode and a lower dielectric, wherein a plurality of cells are carried by the housing and formed around the core;

a channel formed between each cell, wherein the channel is filled with a material having a dielectric property of the lower dielectric; and electrical connection means for connection between an electrical power source and each electrode of each cell for providing power thereto.

2. The device according to claim 1, wherein the core comprises a cylindrical shape having a longitudinal axis extending along a direction of thrust.

3. The device according to claim 2, wherein the core extends beyond a top surface and a bottom surface of a cell assembly for providing a structural attachment to a vehicle with which the device is operable.

4. The device according to claim 1, wherein one set of cells extends radially from a longitudinal axis to form a circular plate with each cell within the plate uniformly positioned therein.

5. The device according to claim 1, wherein the electrical connection means comprise a wire carried through the high dielectric for connection with the electrode at a generally central location thereof.

6. The device according to claim 5, wherein a plurality of wires extends radially from one cell to an adjacent cell within the plate for the connection to the electrical power source.

7. The device according to claim 1, further comprising a bridge conduit extending between adjacent cells within one plate having the adjacent cells therein, the bridge conduit providing a wire path for connection of the electrodes carried within the one plate, the bridge conduit further formed from a dielectric material having the dielectric properties of the high dielectric for the cell.

8. The device according to claim 1, further comprising an electrical power source for providing a rapidly changing voltage and/or current to each of the electrodes within each cell.

9. The device according to claim 8, wherein the electrical power source is operably connected for providing opposing positive and negative voltage and/or current signals to adjacent plates.

10. A device for producing thrust through a preselected shaping of an electric field, the device comprising:

a plurality of cells positioned radially and longitudinally around an axis for forming a cylindrical cell assembly, each cell within the cell assembly having a high dielectric sandwiched between an electrode and a lower dielectric, each cell having a proximal edge closest to the axis of smaller length than a distal edge radially displaced therefrom;

a channel formed between each cell, wherein the channel is generally parallel to the axis and filled with a material having a dielectric property of the lower dielectric; and electrical connection means for connection between an electrical power source and each electrode of each cell for providing power thereto.

11. The device according to claim 10, further comprising a core extending along the axis, the core formed from a material having a high dielectric constant.

12. The device according to claim 11, wherein the core extends beyond a top surface and a bottom surface of the cell assembly for providing a structural attachment to a vehicle with which the device is operable.

13. The device according to claim 10, wherein one set of cells extends radially from the axis to form a circular plate with each cell within the plate uniformly positioned therein.

14. The device according to claim 13, wherein the electrical connection means comprise a wire carried through the high dielectric of each cell for connection to the electrodes of each cell within the plate.

15. The device according to claim 14, wherein a plurality of wires extends radially from one cell to an adjacent cell within the plate for the connection to the electrical power source.

16. The device according to claim 10, further comprising a bridge conduit extending radially between radially located adjacent cells, the bridge conduit providing a wire path for connection of the electrodes of the radially located adjacent cells, the bridge conduit formed from a dielectric material having the dielectric properties of the high dielectric.

17. The device according to claim 10, further comprising an electrical power source for providing a rapidly changing voltage and/or current to each of the electrodes within each cell.

18. A device for producing thrust through a preselected shaping of an electric field, the device comprising:

first and second electrodes having a high dielectric and a lower dielectric sandwiched therebetween;

a channel extending between the first and second electrodes, the channel formed from a material having a dielectric property of the lower dielectric; and electrical connection means for connection between an electrical power source and each of the first and second electrodes for providing a charging power thereto; and an electrical power source for providing a rapidly changing potential between the electrodes for producing an electric field path extend from the first electrode to the second electrode through the channel and the lower dielectric carried therebetween.

19. The device according to claim 18, further comprising a housing formed from a material having a dielectric property of the high dielectric, wherein the first and second electrodes and the high and lower dielectrics are carried within the housing for providing a self-contained device.

20. The device according to claim 18, further comprising the first electrode, the high dielectric, and the lower dielectric forming one cell, and a plurality of cells carried between the one cell and the second electrode.

21. The device according to claim 20, wherein one set of cells extends radially from a longitudinal axis to form a circular plate with each cell within the plate uniformly positioned therein.

22. The device according to claim 21, wherein the electrical connection means comprise a wire carried through the high dielectric for connection with each electrode of the cells within the plane.

23. The device according to claim 22, further comprising a bridge conduit extending between adjacent cells within the plate, the bridge conduit providing a wire path for connection of the electrodes carried within the plate, the bridge conduit further formed from a dielectric material having the dielectric properties of the high dielectric for the cell.

24. A method for providing thrust to a vehicle resulting from the shaping of an electric field between electrodes arranged within a cell assembly including at least one cell having positively charged and opposing negatively charged electrodes with dielectric material carried therebetween, the method comprising the steps of:

forming a cell from a high dielectric sandwiched between an electrode and a lower dielectric;

positioning a plurality of cells around a core to form a plate extending radially outward therefrom, wherein the core is formed from a material having a similar dielectric property as the high dielectric;

forming a channel between each cell, wherein the channel is filled with a material having a dielectric property of the lower dielectric;

positioning a plurality of plates for providing a cell assembly having a plurality of electrodes;

making an electrical connection between an electrical power source and each electrode of each cell for providing power thereto; and providing power to each cell with opposing charging of adjacent electrodes for providing a preselected field path through the channel and lower dielectric, and thus thrust to the vehicle to which the cell assembly is connected.

25. The method according to claim 24, wherein the cell forming step comprises the step of providing the high dielectric with a larger thickness dimension than the lower dielectric to enhance prevention of an electric field path therethrough.

26. The method according to claim 24, further comprising the steps of:

providing a housing formed from a material having a similar dielectric property as the core; and carrying the cell assembly and core within the housing for providing a self-contained device used to provide thrust to the vehicle.

27. The method according to claim 24, wherein the plate stacking step comprises the steps of longitudinally stacking a plurality of plates along an axis of the core, which axis is a longitudinal axis of a cylindrical shaped core.

28. The method according to claim 27, wherein the core extends beyond a top surface and a bottom surface of the cell assembly for providing a structural attachment to the vehicle.

29. The method according to claim 24, wherein a first set of cells extends radially from a longitudinal axis to form a circular plate with each cell within the plate uniformly positioned therein.

30. The method according to claim 24, wherein the power providing step comprises the step of extending a wire through the high dielectric for connection with the electrode at a generally central location thereof.

31. The method according to claim 30, wherein a plurality of wires extends radially from the cell to the adjoining cell within the plate for the connection to the electrical power source.

32. The method according to claim 31, further comprising the steps of:

providing a bridge conduit extending between neighboring cells within one plate having the neighboring cells therein; and extending the wire through the bridge conduit for providing a wire path for connection of the electrodes carried within the one plate, wherein the bridge conduit is formed from a dielectric material having the dielectric properties of the high dielectric for the cell.

33. The method according to claim 24, wherein the power providing step includes the step of providing a rapid power change to the electrodes for enhancing the thrust.

* * * * *